US005211259A

United States Patent [19]

Kishi

[11] Patent Number: 5,211,259

[45] Date of Patent: May 18, 1993

[54] LIFTING APPARATUS

[75] Inventor: Mitsuhiro Kishi, Tochigi, Japan

[73] Assignee: Japanic Corporation, Ashikaga, Japan

[21] Appl. No.: 783,638

[22] Filed: Oct. 24, 1991

[30] Foreign Application Priority Data

Oct. 31, 1990 [JP] Japan ..... 2-296884

[51] Int. Cl.[5] ..... B66F 11/04

[52] U.S. Cl. ..... 182/2; 182/63

[58] Field of Search ..... 182/2, 141, 63, 148, 182/128; 187/9 R, 17

[56] References Cited

U.S. PATENT DOCUMENTS 4,691,805 9/1987 Kishi ..... 182/2 X
4,694,930 9/1987 Kishi ..... 182/2
5,082,085 1/1992 Ream et al. ..... 182/2

FOREIGN PATENT DOCUMENTS 63-27280 6/1988 Japan .
63-59959 11/1988 Japan .
3-38194 6/1991 Japan .

*Primary Examiner*—Blair M. Johnson
*Attorney, Agent, or Firm*—Flynn, Thiel, Boutell & Tanis

[57] ABSTRACT

A lifting apparatus has a movable chassis, a vertically movable platform disposed over the chassis and a telescopic boom body connected between the chassis and the boom body and arranged to form a Z-shape in side view. An angle detector gives a signal indicative of the angle of inclination of the boom body relative to the chassis. The boom body is extended at a rate correlated to the angle of inclination of the boom body so that the upper end of the boom body moves vertically relative to the chassis.

8 Claims, 15 Drawing Sheets

LIFTING APPARATUS

BACKGROUND OF THE INVENTION

1. Field of the Invention

The present invention relates to a lifting apparatus capable of moving a platform vertically above a chassis so as to raise and lower an operator, an object or a material located on the platform and, more particularly, to a lifting apparatus having a simple structure composed of one telescopic boom body and, yet, which can function in a manner equivalent to that of a conventional lifting apparatus having plural telescopic boom bodies, and which is capable of lengthwise extension and contraction at a rate correlated to the angle of inclination of the telescopic boom body with respect to the vertical.

2. Description of the Prior Art

Lifting apparatuses are widely used for assembling, painting and repairing highway bridges, building constructions or the like, which are in elevated locations. In such apparatuses, an operator, an object or a material is placed on a platform which is then raised or lowered.

A conventional lifting apparatus comprises a plurality of groups of arms, wherein each group of arms comprises a pair of arms which are pivotally connected at the central portion thereof. The plurality of groups of arms are assembled as one unit for forming a pantograph by combining the plurality of groups of arms vertically (a so-called scissors-type lifting apparatus). In the conventional arrangement of such an apparatus, it is necessary to lengthen each arm or to increase the number of groups of arms to be connected with one another in order to increase the height to which the platform can be raised. Accordingly, if a lifting apparatus capable of raising a platform to a higher position is designed, a plurality of groups of pantographs are required. This involves the problem that when the lifting apparatus is in its collapsed state wherein the linkage is folded, the platform is higher than is desired and the operation of loading the operator or the material is troublesome.

There was proposed another lifting apparatus capable of stretching one arm in the longitudinal direction thereof by inserting a plurality of booms stretchably into an arm (as disclosed in, e.g., Japanese Patent Application No. 56-134487 and No. 56-191065). In that lifting apparatus, middle booms comprising one group composed of a pair of middle booms are rotatably assembled at the central portion thereof in an X-shape, and two groups of middle booms are arranged in parallel with each other wherein an upper boom and a lower boom are respectively inserted into each middle boom so as to connect the chassis to the platform. This lifting apparatus has the problem that the numbers of booms are increased and the numbers of components are also increased, which involves laborious work for manufacture and assembly thereof, with consequent high cost.

In that apparatus, the sliding portions of each boom are increased which requires slidable parts composed of synthetic resins, such as polyamide, for keeping in good condition the zone in which the sliding portions slide. These sliding parts should be regularly replaced with new parts. This involves an increase of the number of sliding parts and laborious work for inspection and maintenance, and high cost thereof.

To solve those problems, there was proposed another lifting apparatus comprising one elongatable boom and forming a Z-shape viewed from the side (Japanese Patent No. 59-95797). In this mechanism, it is necessary to control the direction in which the one elongatable boom extends and to control the inclination angle for inclining the one elongatable boom upwardly and downwardly, wherein both controls should be made to operate in synchronism with each other. Both controls necessitate a telescopic measuring unit for measuring the elongation amount of a telescopic boom body and an angle measuring unit for measuring the inclination angle of the telescopic boom body relative to the horizontal, wherein both units issue detecting signals which are calculated so as to control a first hydraulic cylinder for adjusting the inclination angle and a second hydraulic cylinder for controlling telescoping of the boom. It is complex to arrange these two measuring units in the lifting apparatus in view of the complicated assembly thereof. Furthermore, a calculating computer, such as microcomputer and the like, is required for calculating the detected signals issued by the two measuring units. The measuring units and the computer, respectively, are high cost items, which result in an increase of the manufacturing cost of the lifting apparatus as a whole. The cost of the measuring units and the computer do not greatly influence the total cost of a large size lifting apparatus, but they significantly influence the total cost of a small size lifting apparatus because the cost price ratio of the computer is high relative to the total cost of the small size lifting apparatus.

The proposed Z-shaped lifting apparatus has the advantages that it requires fewer components compared with the conventional scissors-type lifting apparatus and the X-shaped lifting apparatus. However, this Z-shaped lifting apparatus has a drawback that the controlling mechanism is complex and involves high cost because the telescopic boom body should be controlled in respect of inclination angle and the lengthwise extension and contraction.

Accordingly, it is desired to provide a simplified control mechanism capable of lifting the platform vertically relative to the chassis without rotating two measuring units for measuring the elongation of the telescopic boom body and the inclination angle of the telescopic boom body and without providing a computer for calculating the detecting signals issued by these measuring units. Particularly, the control mechanism can mechanically control the platform relative to the chassis without resorting to electronic instrument apparatuses, such as high-priced computers.

SUMMARY OF THE INVENTION

It is an object of the present invention to provide a lifting apparatus comprising a movable chassis, a flat platform disposed over the chassis, a telescopic boom body composed of a plurality of booms which extend into the telescopic boom body in the longitudinal direction thereof and are disposed between the chassis and the platform, an inclining means capable of raising the telescopic boom body to an inclined position, the inclining means being interposed between the chassis and the telescopic boom body, and a lengthwise extension means capable of telescopically elongating and contracting the telescopic boom body and housed inside the telescopic boom body, wherein the platform and the telescopic boom body are disposed to form a Z-shape when viewed from the side thereof and the telescopic boom body is telescopically moved and inclined relative to the chassis so as to move the platform vertically.

According to the invention, an angle detecting means is provided for issuing a signal corresponding to the angle of inclination of the telescopic boom body relative to the chassis each time the telescopic boom body is inclined relative to the chassis and a prescribed amount of oil under pressure is supplied to the boom telescoping means every time the signal is issued by the angle detecting means for permitting the lengthwise extension speed of the telescopic boom body to follow the variation of the angle of inclination of the telescopic boom body relative to the chassis so that the upper end of the telescopic boom body can be vertically moved relative to the chassis.

DESCRIPTION OF THE PREFERRED EMBODIMENT

A lifting apparatus according to a preferred embodiment of the present invention will be described hereinafter with reference to FIGS. 1 to 15.

Figure 1:
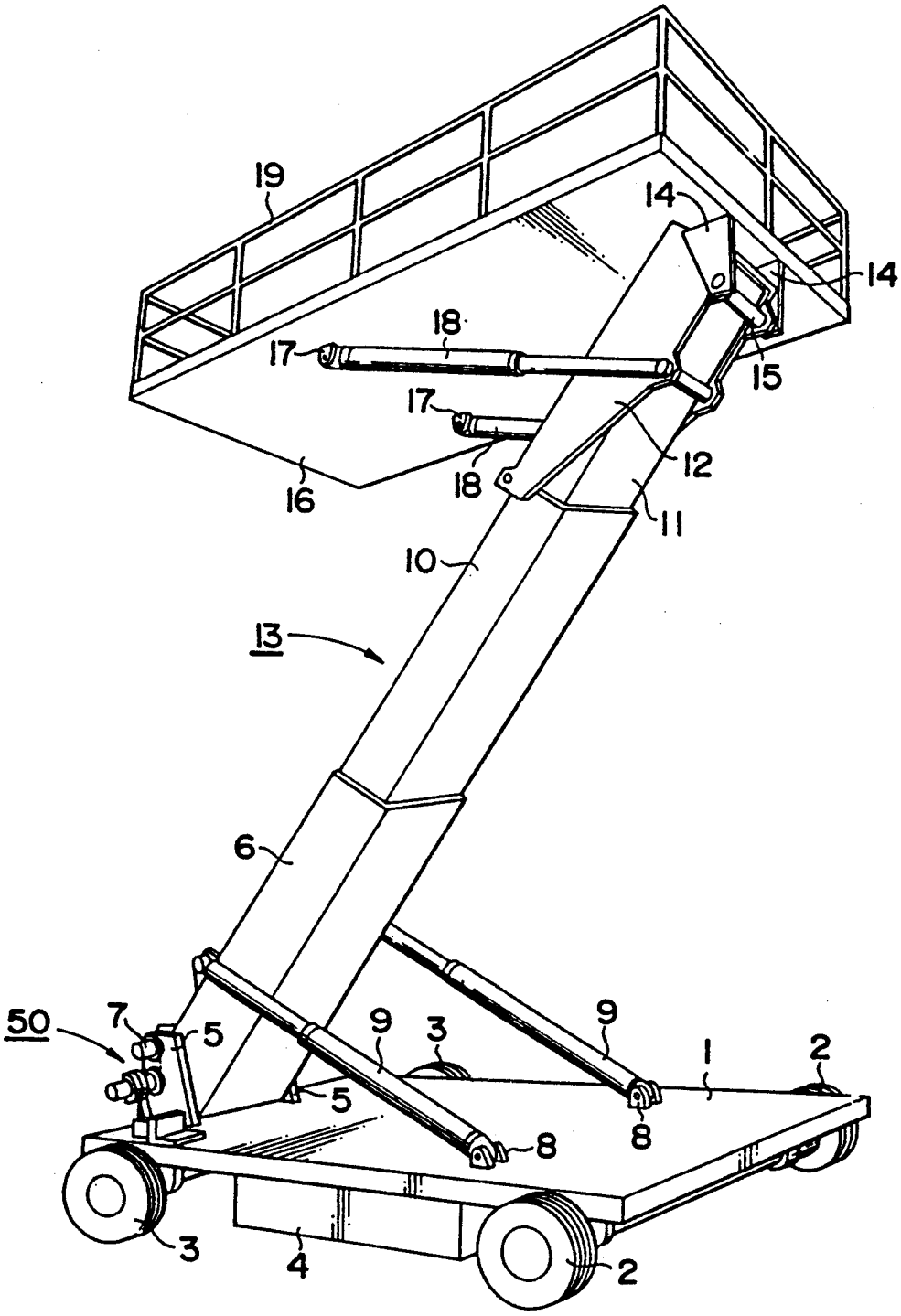
FIG. 1 is a perspective view showing a state wherein a platform, one of the components of the lifting apparatus according to a preferred embodiment of the present invention, is at its maximum height.
Figure 2:
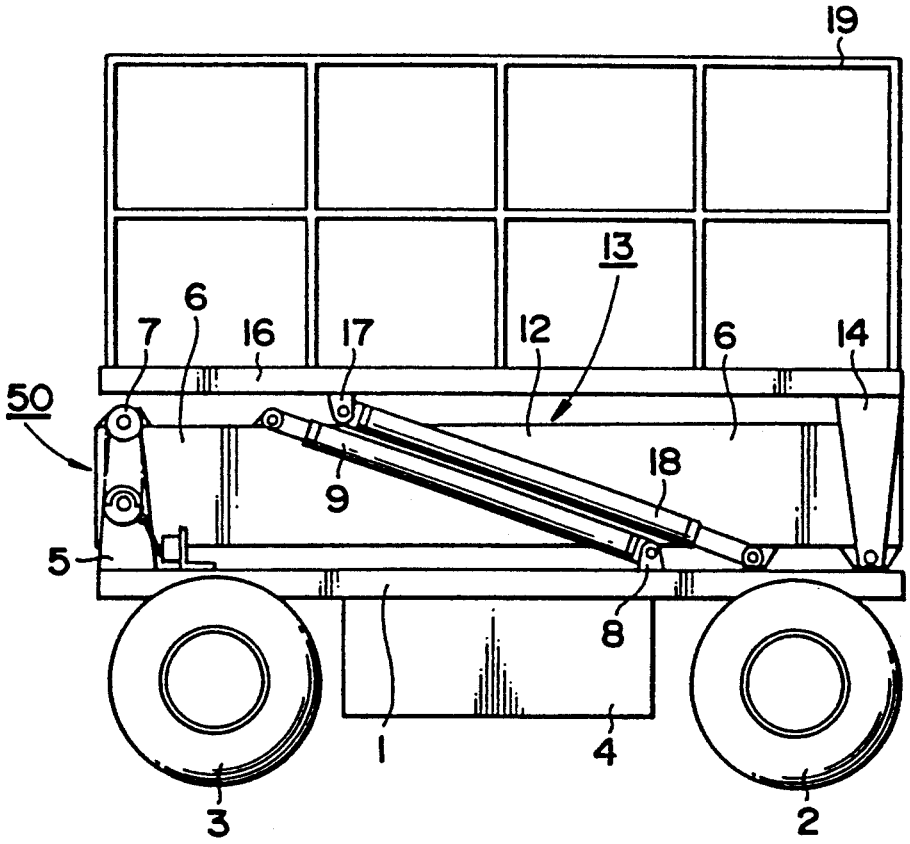
FIG. 2 is a side view showing a state wherein the platform is at its lowest position.
Figure 3:
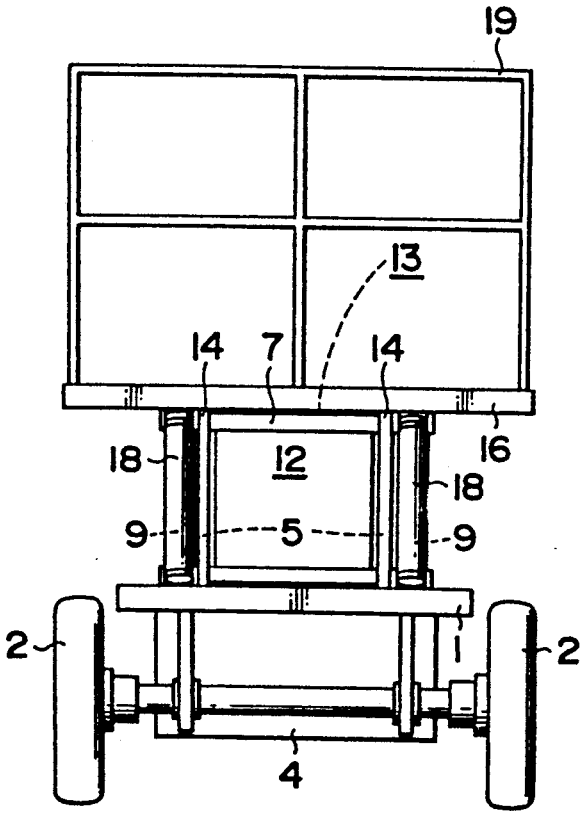
FIG. 3 is a front view of the lifting apparatus in FIG. 2.
Figure 4:
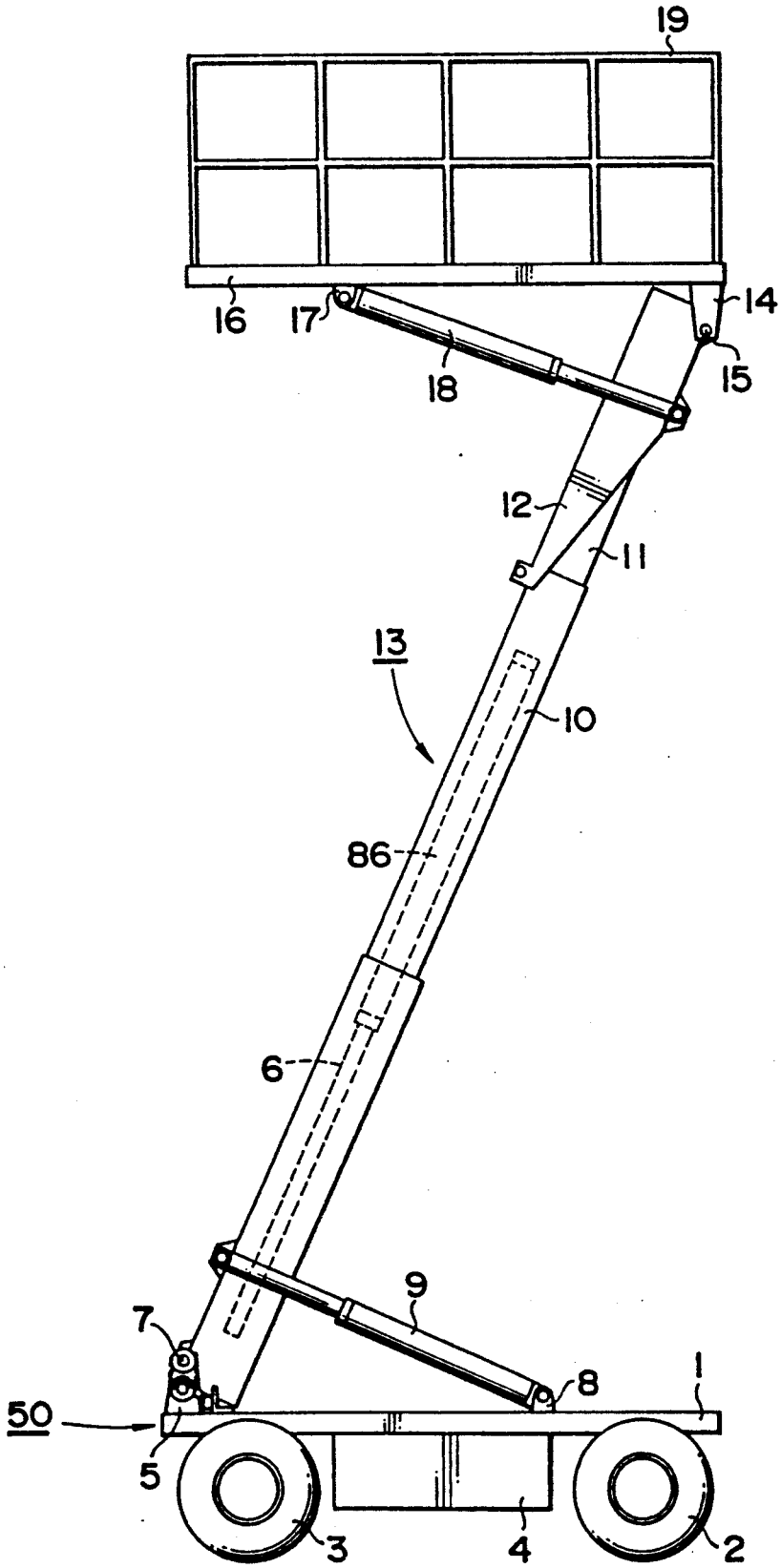
FIG. 4 is a side view showing a state wherein the platform is raised to its maximum height.

FIG. 1 is a perspective view showing a state wherein a platform, one of the components of a lifting apparatus according to a preferred embodiment of the present invention, is at its maximum height, FIG. 2 is a side view showing a state where the platform is at its lowest position, FIG. 3 is a front view of the lifting apparatus in FIG. 2, and FIG. 4 is a side view showing a state wherein the platform is raised to its maximum height.

The chassis 1 of the lifting apparatus is supported by a pair of front wheels 2 and a pair of rear wheels 3, located at the front and rear portions thereof and at the left and right sides thereof, whereby the chassis 1 is freely movable along the ground. A drive housing 4 containing therein an engine 80, a hydraulic pump 81 and related equipment (FIG. 12) is attached to the lower portion of the chassis 1. A pair of supporting brackets 5 are fixedly mounted on the upper surface of the chassis 1 at one side thereof (at the side close to the rear wheels 3) with there being a preselected space between said brackets. A lower boom 6, which is hollow and of square cross-section is disposed between the supporting brackets 5. The supporting brackets 5 and the lower end of the lower boom 6 are respectively pivotally connected with each other by pins 7 so that the lower boom 6 can be pivoted upwardly and downwardly relative to the chassis 1. The pins 7 are pivotally supported by the supporting brackets 5. A pair of mounting members 8 are fixed to the upper surface of the chassis 1 and are disposed opposite to the supporting brackets 5 (toward the front side of the chassis) and on the opposite lateral sides of the lower boom 6. A pair of first hydraulic cylinders 9 serve as an inclining means for changing the angle of inclination of the lower boom body 6 relative to the chassis 1. Corresponding one ends of the cylinders 9 are disposed between and are pivotally connected to the mounting members 8. The other ends of the cylinders 9 extend on opposite sides of the lower boom 6 and are pivotally connected thereto.

Figure 6:
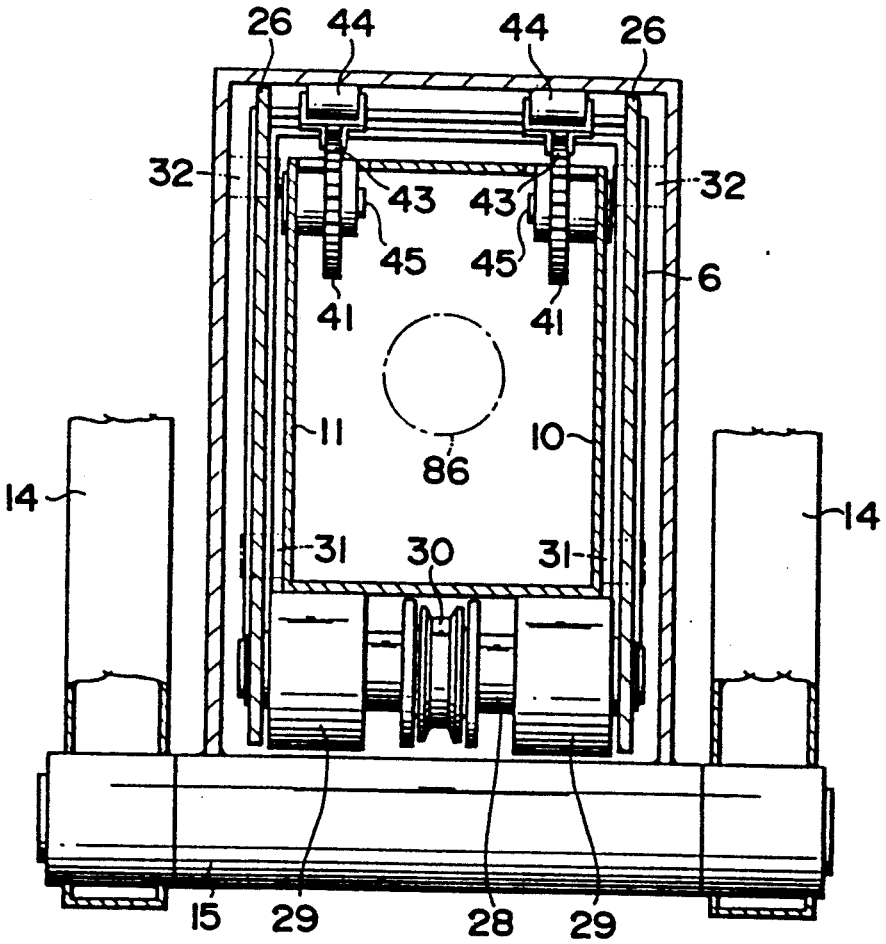
FIG. 6 is a cross-sectional view taken along the cutting line 6—6 in FIG. 5 and showing the telescopic boom body in its extended position.
Figure 7:
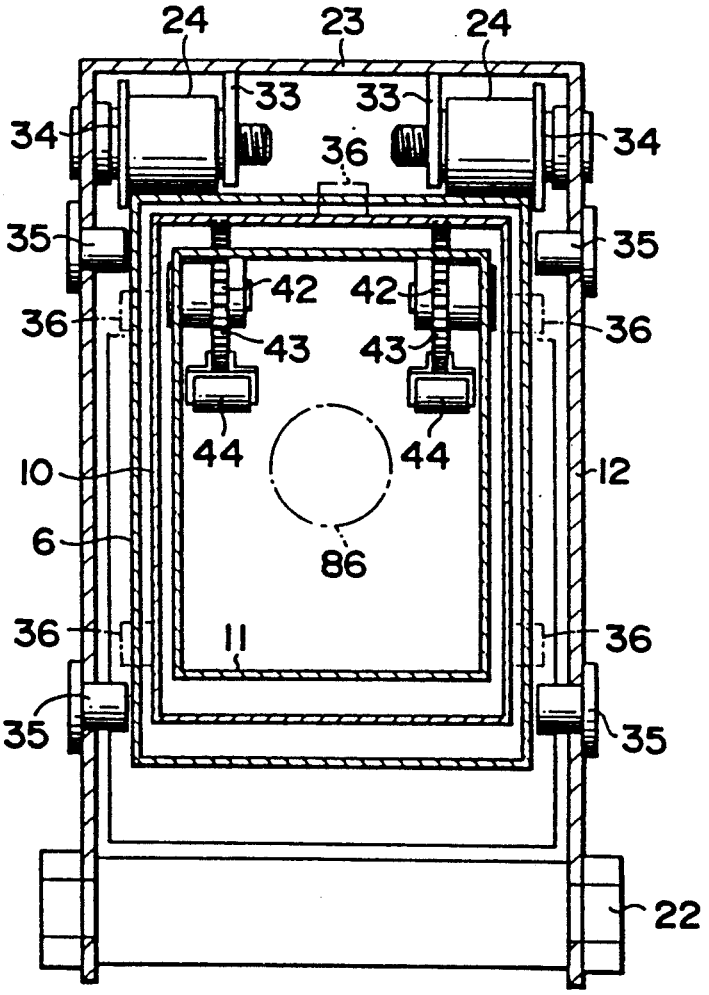
FIG. 7 is a cross-sectional view taken along the cutting line 7—7 in FIG. 5 and showing the telescopic boom body in its contracted position.

The lower boom 6 has an open upper end which is square in cross section. A middle boom 10, which also is hollow and of square cross section, telescopically slidably extends into the central opening of the lower boom 6 for lengthwise movement in the longitudinal direction thereof. An upper boom 11, which also is hollow and of square cross section, similarly telescopically slidably extends into the central opening of the middle boom 10 at the open upper end thereof for lengthwise movement therein. A cover body 12, which has an inverted U-shaped cross section and which is open along the lower side thereof, is fixed to the upper end of the upper boom 11. The upper inside surface of the upper wall of the cover body 12 is spaced from and extends in parallel with the upper outside surface of the lower boom 6 when the lifting apparatus is in its collapsed state (FIGS. 2, 6 and 7). The walls of the upper boom 11 and the cover body 12 are spaced apart to define a gap therebetween in which the lower boom 6 can be received. Each of the lower boom 6, the middle boom 10 and the upper boom 11 has a length substantially the same as that of the chassis 1. The lower boom 6, the middle boom 10 and the upper boom 11 collectively define a telescopic boom body 13.

Designated at 16 is a platform having a floor area which is substantially the same as that of the chassis 1. A pair of supporting pieces 14 are fixed to the lower surface of the platform 16 close to the front end thereof (at the side of the front wheels 2). The upper end of the cover body 12 is inserted between the supporting pieces 14. The cover body 12 is pivotally connected to the supporting pieces 14 by a pin 15. A pair of mounting members 17 are fixed to the lower surface of the platform 16 at locations spaced from the shaft-supporting pieces 14 (toward the side close to the rear wheels 3). A pair of second hydraulic cylinders 18 for positioning the platform 16 relative to the chassis 1 are pivotally connected and extend between the mounting members 17 and opposite sidewalls of the cover body 12. A handrail 19 is mounted on the upper side of the platform 16 for preventing material or an operator on the platform from falling off.

An angle detecting means 50 is provided at one of the supporting brackets 5 for detecting the angle of inclination of the lower boom 6 relative to the chassis 1. The structural arrangement of the angle detecting means 50 will be described in more detail later.

Figure 5:
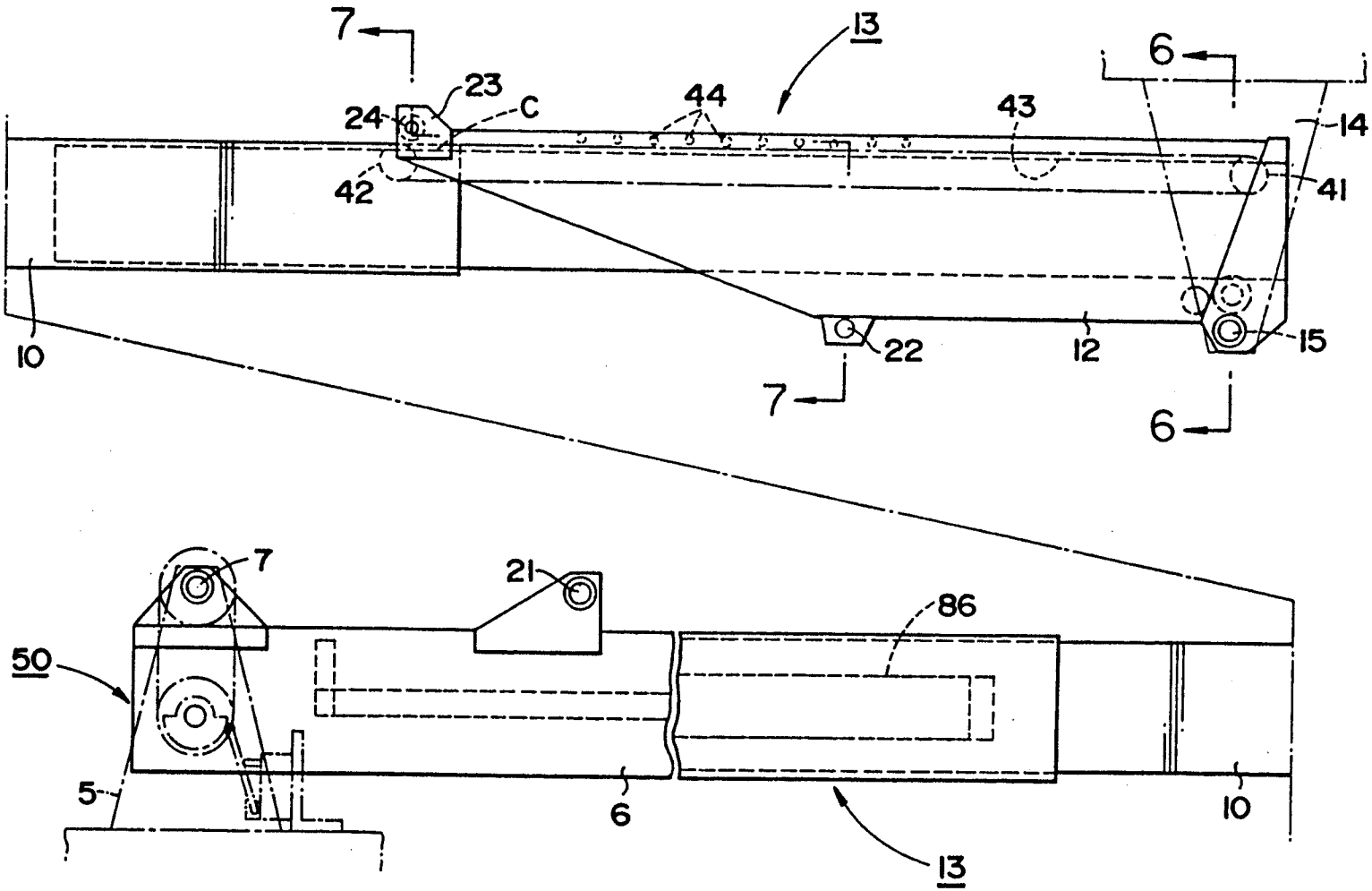
FIG. 5 is a schematic side view stowing the internal structure of the telescopic boom body.

FIG. 5 schematically shows the internal structure of the telescopic boom body 13. The upper boom 11 and the middle boom 10 are respectively telescopically receivable into each other and into the lower boom 6. The cover body 12 is attached to the upper boom 11 and has an upper side, the length of which is about two-thirds of the total length of the lower boom 6. The cover body 12 has a lower side length which is one-third of the total length of the lower boom 6. The left edge (in FIG. 5) of the cover body 12 slants to the right in the downward direction thereof. Pin holes 21 are provided on the upper side of the lower boom 6 at a position located about one-third of the total length thereof from the left end thereof, for connecting the first hydraulic cylinders 9 to the lower boom 6. Pin holes 22 are provided at the lower edge of the cover body 12 at a position located about one-third of the entire length thereof, for connecting the second hydraulic cylinders 18.

Support portions 23 are fixed at the upper edge of the cover body 12 at the left end thereof. Rollers 24 are supported by the shaft-supporting portions 23 so as to rollably contact the upper surface of the lower boom 6. A pair of sprocket wheels 41 are supported inside of and at the upper end of the upper boom 11 (right side in FIG. 5, see also FIG. 6). A second pair of sprocket wheels 42 are supported inside of and at a position located one-third of the total length of the upper boom 11 from the lower end thereof (left side in FIG. 5). Chains 43 are trained around the sprocket wheels 41 and 42. The ends of the chains 43 are positioned (i.e. anchored) at the upper end of the middle boom 10 (at the position denoted at C in FIG. 5). Ten rollers 44 are spaced apart from each other along the upper side of each of the chains 43. The rollers 44 serve as spacers and they are low-friction slidable materials formed of polyamide resin. The rollers 44 rollably contact the inner surface of the upper wall of the cover body 12 (FIG. 6).

FIG. 6 is a cross-sectional view taken along the cutting line 6—6 of the telescopic boom body in FIG. 5.

Auxiliary plates 26 are fixed to both sides of the upper or tip end of the middle boom 10 (right end in FIG. 5). A supporting shaft 28 is fixed at the lower portion of the auxiliary plates 26 and rollers 29 are rotatably supported by the supporting shaft 28 and disposed inside the auxiliary plates 26 so as to rollably contact with the lower surface of the upper boom 11. A pulley 30 is supported by the supporting shaft 28 at the central portion thereof for rotating chains (not shown) to connect the lower boom 6 with the upper boom 11. The auxiliary plates 26 have sliders 31 for slidably contacting the outside of the upper boom 11 and sliders 32 for slidably contacting an inner portion of the cover body 12. The pair of sprocket wheels 41 are supported by shafts 45 at the upper portion of the inner wall of the upper boom 11 at the right and left sides thereof and chains 43 are trained around each sprocket wheel 41. The plurality of spacer rollers 44 are provided close to each chain 43 and in a spaced relation thereto.

FIG. 7 is a cross-sectional view taken along the cutting line 7—7 of the telescopic boom body in FIG. 5.

A pair of supporting pieces 33 are fixed to the inner wall of the shaft-supporting portion 23 at the right and the left sides thereof so as to be positioned in parallel with the side walls of the shaft supporting portion 23. Pins 34 are supported between the side surfaces of the shaft-supporting portion 23 and each supporting piece 33. The rollers 24 are each respectively supported by a pin 34. The rollers 24 are adapted to rollably contact the upper surface of the lower boom 6 when the telescopic boom body is fully telescoped. Liners 35 are fixed to the side surfaces of the cover body 12 so as to slidably contact the lower boom 6. Liners 36 are fixed to the lower boom 6 so as to slidably contact the periphery of the middle boom 10. The sprocket wheels 42 are supported on the inner wall of the upper boom 11 at the right ant left sides thereof and the lower portion thereof and chains 43 are trained around the sprocket wheels 42.

Figure 8:
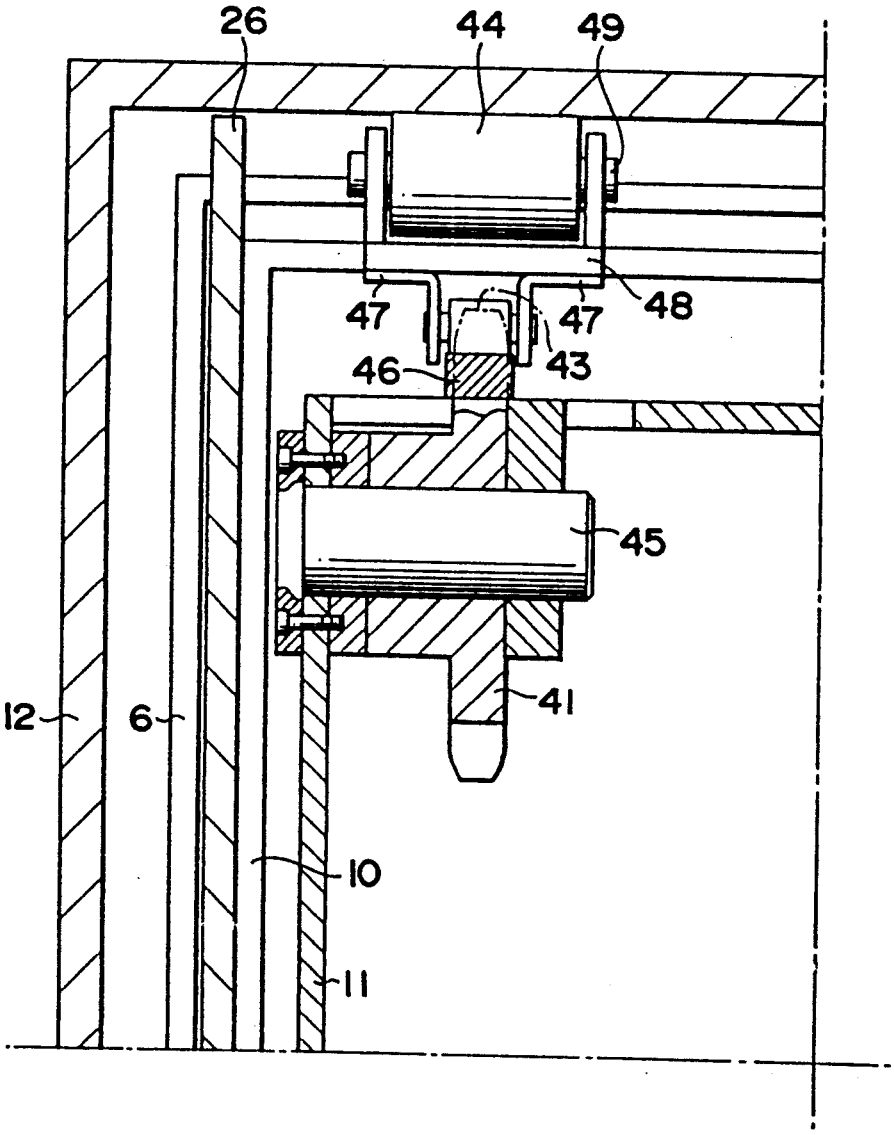
FIG. 8 is an enlarged, cross-sectional view of a fragment of FIG. 6 and showing a portion close to the rollers provided on the upper boom.

FIG. 8 is an enlarged view showing a portion close to the sprocket wheels 41 at the left side in FIG. 6.

A pin 45 protrudes inwardly from the inner wall of the upper boom 11. The sprocket wheel 41 is rotatably supported by the pin 45. The chain 43 is trained around the sprocket wheel 41. A rail 46 formed of a synthetic resin, such as polyamide, is fixed to the upper surface of the upper boom 11 and is disposed in parallel with the longitudinal direction of the upper boom 11. The rollers of the chain 43 contact the upper surface of the rail 46 so that the rollers of the chains 43 can rotate therearound. A pair of angled pieces 47 formed in L-shape are connected to opposite sides of the chain 43. A shaft-supporting body 48, which is open at the upper portion thereof and formed in a U-shape, is fixed between the angled pieces 47. The shaft 49 supporting the rollers 44 is fixed to the shaft supporting body 48.

Figure 9:
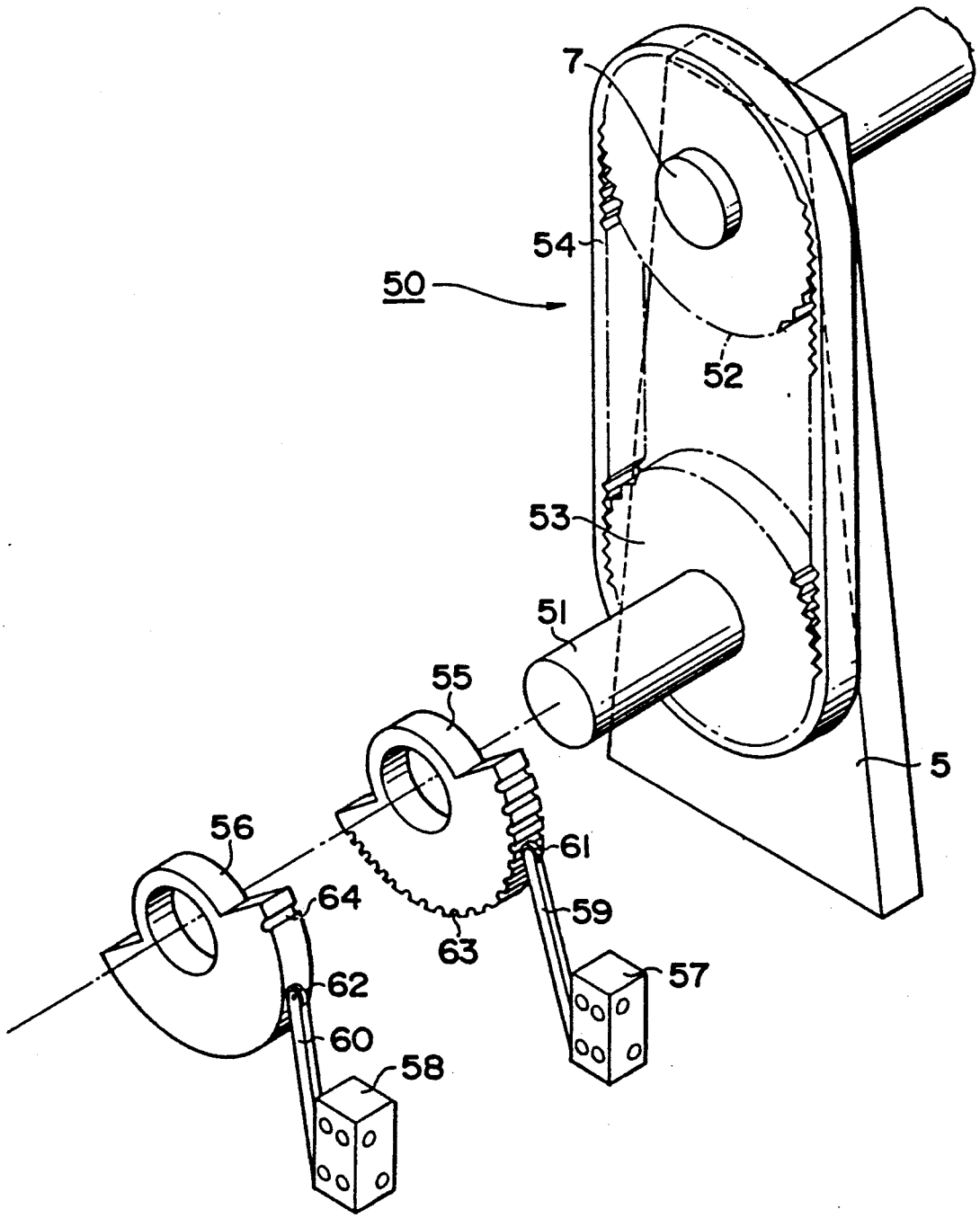
FIG. 9 is an exploded perspective view showing an arrangement of an angle detecting means, one of the components of the lifting apparatus.

FIG. 9 shows the arrangement of the angle detecting means in detail.

A detecting shaft 51 is rotatably supported at the lower portion of the shaft-supporting bracket 5. A gear 52 is fixed to the pin 7 and a gear 53 is fixed to the detecting shaft 51, respectively, at the outside of the shaft-supporting bracket. A belt 54 is trained around the gears 52 and 53 so that the gears 52 and 53 are turned in synchronism with each other by the belt 54 so as to be drivingly interconnected with each other. Fixed to the detecting shaft 51 are a signal disk 55 in the shape of a semicircular arc, for synchronism purposes, and a signal disk 56, for resetting purposes. A first timing switch 57 is provided at the location close to the signal disk 55 while a second timing switch 58 is provided at a location close to the signal disk 56. A roller 61 is provided at the tip end of a lever 59 of the first timing switch 57 and it contacts the outer periphery of the signal disk 55. The second timing switch 58 has a lever 60, a tip end of which supports a roller 62 which contacts the outer periphery of the signal disk 56.

Figure 10:
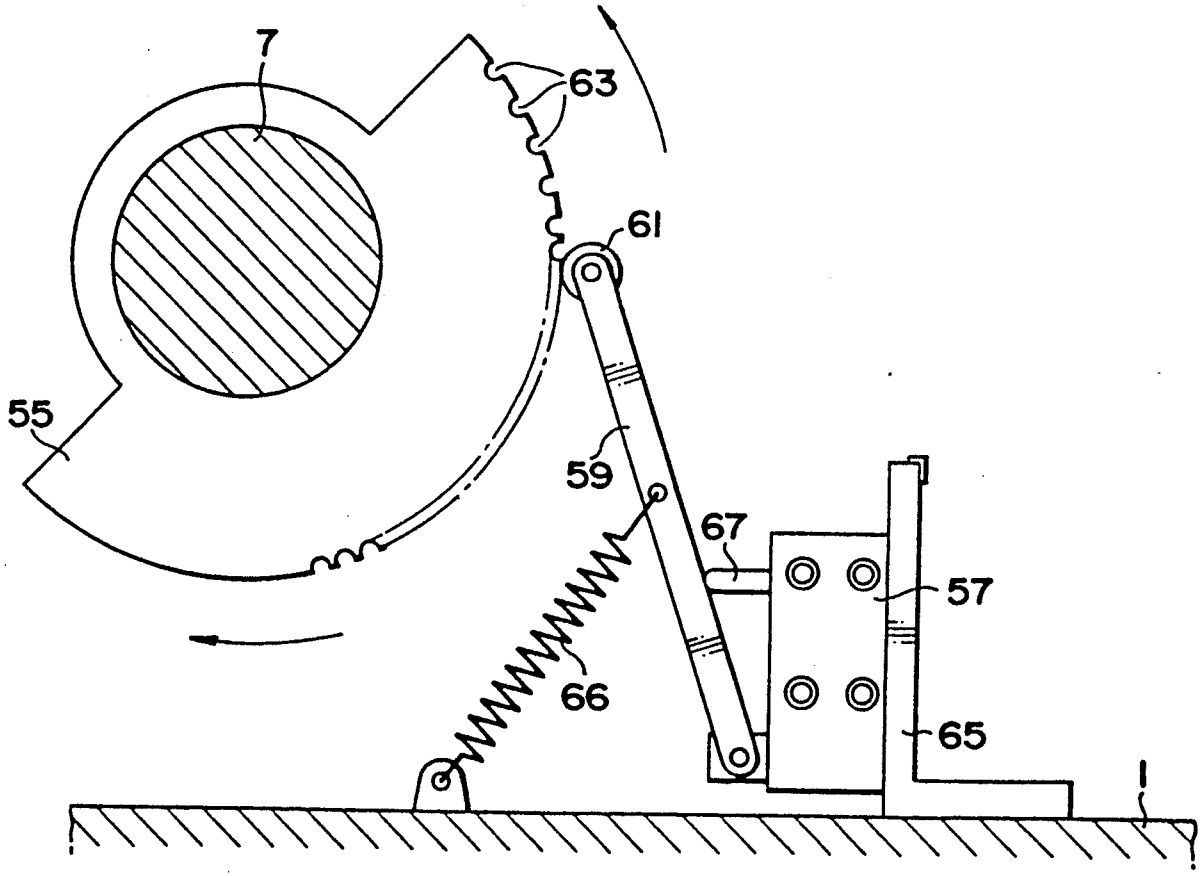
FIG. 10 and 11 are side views showing portions close to signal disks, one of the components of the lifting apparatus.

FIG. 10 is a side view showing a portion close to the signal disk 55.

A plurality of circumferentially spaced-apart signal grooves 63 are formed by cutting the outer periphery of the signal disk 55 in the circumferential direction thereof. The signal grooves 63 are circumferentially spaced-apart different distances in the clockwise direction of rotation of the signal disk 55. The reasons for this will be discussed hereinbelow. An L-shaped channel 65 is fixed to the upper surface of the chassis 1 to which the timing switch 57 is fixed. The lever 59 extends from the lower portion of the timing switch 57 so as to be turned upward and has the roller 61 supported at the tip end thereof. The roller 61 contacts the outer periphery of the signal disk 55. The lever 59 is always biased against the signal disk 55 by a spring 66 connected to the chassis 1 at one end thereof. The first timing switch 57 has a rod 67 protruding therefrom for turning on or off a detecting circuit. The rod 67 contacts a side surface of the arm 59.

Figure 11:
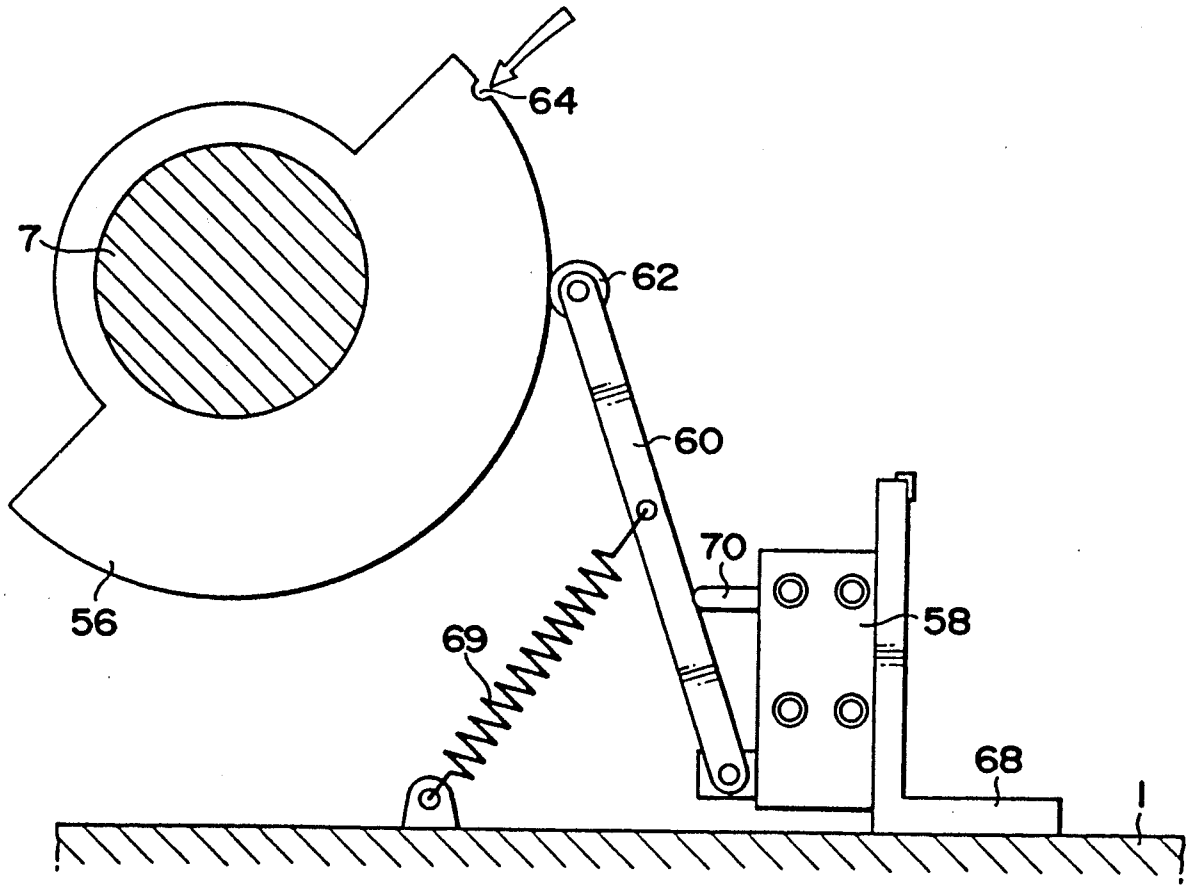

FIG. 11 is a side view showing a portion close to the signal disk 56.

A reset groove 64 is defined on the surface of the signal disk 56, at the location that the roller 62 contacts when the lower boom 6 is positioned horizontally, for issuing a reset signal. An L-shaped channel 68 is fixed to the upper surface of the chassis 1 and the second timing switch 58 is fixed to the channel 68. The lever 60 is rotatably connected to the second timing switch 58 and has the roller 62 supported at the tim end thereof for contacting the outer periphery of the signal disk 56. A spring 69 for always biasing the lever 60 against the signal disk 56 is interposed between the lever 60 and the chassis 1. The second timing switch 58 has a rod 70 protruding therefrom for turning on or off the detecting circuit. The rod 70 contacts the side surface of the lever 60.

Figure 12:
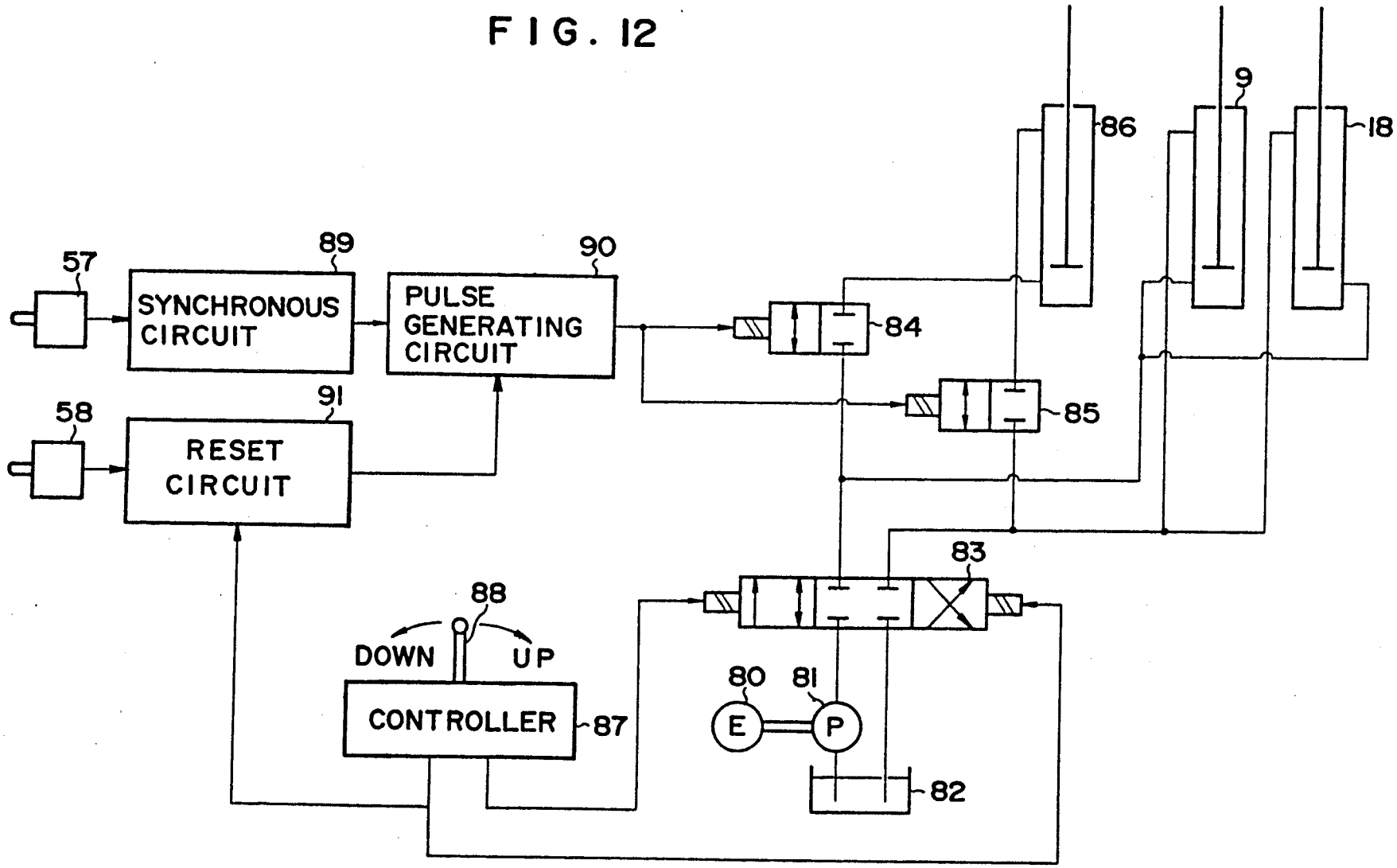
FIG. 12 is a hydraulic circuit diagram showing a control system of the lifting apparatus.

FIG. 12 is a hydraulic circuit diagram of the lifting apparatus according to the present invention.

A hydraulic pump 81 driven by an engine 80 has a suction side communicating with an oil tank 82 and a discharge side connected to a solenoid control valve 83 which is switchable into three positions. The control valve 83 has a discharge side which is connected to the oil tank 82.

The control valve 83 is connected in parallel with the first and second hydraulic cylinders 9 and 18 at the output side thereof and to the solenoid synchronous valves 84 and 85 which are respectively closed in the normal state. The solenoid synchronous valves 84 and 85 are respectively connected to a hydraulic cylinder 86 for telescopically moving the telescopic boom body 13. The third hydraulic cylinder 86 is housed inside the telescopic boom body 13 for telescopically moving the middle and upper booms 10 and 11 together with the mechanism of the chain and the like.

Designated at 87 is a controller having a lever 88. The platform 16 can be vertically moved by the operation of the lever 88. Control output from the controller 87 for raising or lowering the platform 15 is connected to the solenoid coils of the control valve 83. The timing switch 57 is connected to a synchronous circuit 89 for carrying out wave forming. An output of the synchronous circuit 89 is connected to a pulse generating circuit 90 and an output of the pulse generating circuit 90 is connected to the solenoid coils of the synchronous valves 84 and 85. An output of the timing switch 58 is connected to a reset circuit 91 and an output of the reset circuit 91 is connected to the pulse generating circuit 90 for supplying a reset signal from the reset circuit 91 to the pulse generating circuit 90. The controller 87 is connected to the reset circuit 91 for supplying a lowering signal from the controller 87 to the reset circuit 91.

The operation of the lifting apparatus, according to the present invention, will be described hereinafter.

FIGS. 2 and 3 are views showing the states where the telescopic boom body 13 is contracted to thereby lower the platform 16 to its lowest position. At this state, the operator and/or the material are respectively loaded on the platform 16 and the platform 16 is raised. Firstly, to raise the platform 16, the engine 80 provided in the drive box 4 is operated to drive the hydraulic pump 81 so that the oil is sucked from the oil tank 82 to place the oil under pressure. The oil under pressure is supplied from the oil tank 82 to the control valve 83, and thereafter supplied to the first to third hydraulic cylinders 9, 18 and 86 so that the platform 16 is raised or lowered.

When the oil under pressure is supplied to the hydraulic cylinders 9 and 18, the rods of the first and second hydraulic cylinders 9 and 18 respectively move longitudinally whereby the lower boom 6 is turned relative to the pin 7. As a result, the telescopic boom body 13 is inclined upwardly gradually, relative to the chassis 1. This operation can be first carried out by switching the control valve 83 to the "normal" position. The operations of the hydraulic cylinders and 18 always precede the operation of the third hydraulic cylinder 86.

When the oil under pressure is supplied to the hydraulic cylinder 86 by way of the solenoid synchronous valves 84 and 85, the oil under pressure operates to telescopically elongate the telescopic boom body 13. That is, the middle boom 10, which is longitudinally slidable in the lower boom 6, is pulled out from the lower boom while the upper boom 11, which is longitudinally slidable in the middle boom 10, is pulled out from the middle boom so that the distance between the pins 7 and the pin 15 is increased. During the telescopic movement, the rollers 24 contact the upper surface of the lower boom 6 and move lengthwise on the upper surface of the lower boom 6 while rolling thereon.

Inasmuch as there are gaps between the cover body 12 and the lower boom 6, the middle boom 10 and the upper boom 11, play is likely to occur in the gaps whereby the telescopic boom body 13 is liable to be deformed. However, the load of the platform 16 is transmitted to the pin holes 22 by way of the second hydraulic cylinders 18 so that the stress for bending downward is applied to the cover body 12 because the stress is applied on the pin holes 22. Since the rollers 24 roll on the upper surface of the lower boom 6, the load of the platform 16 is supported by the rollers 24 and from thence is transmitted to the lower boom 6, the cover body 12 is not deformed and moves upwardly together with the upper boom 11.

When the lower boom 6 moves relative to the cover body 12, the upper end of the lower boom 6 passes under the lower surfaces of the rollers 24. However, since the upper end of the middle boom 10 slides so as to move away from the upper end of the upper boom 11 and is pulled out from the upper boom 11 when the telescopic boom body 13 is telescopically moved, the chains 43 are pulled out from the inside of the upper boom 11 and roll on the rail 46 so as to rotate the sprocket wheels 41 and 42. Since the chains 43 slide on the rail 46, the chains 43 move smoothly and at the same time the rollers 44 fixed to the chains 43 are also moved.

Accordingly, the rollers 44 fixed to the chains 43 are also moved together with the middle boom 10 so that each roller 44 moves into the space defined between the upper boom 11 and the cover body 12. These rollers 44 roll on the inner wall of the cover body 12 while contacting the inner wall so that the load of the platform 16 applied to the cover body 12 is transmitted to the upper end of the upper boom 11 by way of the rollers 44, the chains 43 and the rail 46 even if the rollers 24 are moved away from the lower boom 6, the cover body 12 is not likely to be deformed by the load applied to the cover body 12 because each roller 44 contacts the inner wall of the cover body 12.

Figure 13A:
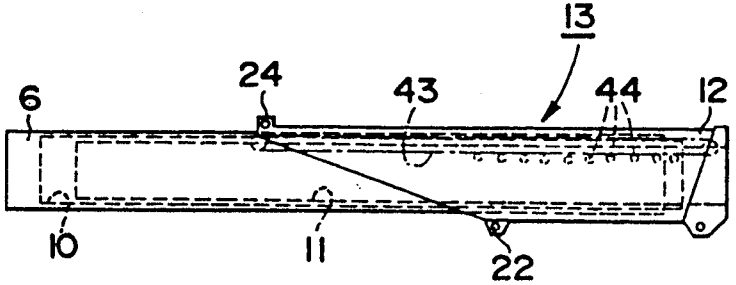
FIGS. 13(*a*), 13(*b*) and 13(*c*) are views showing the operation of the telescopic boom body, one of the components of the lifting apparatus.
Figure 13B:
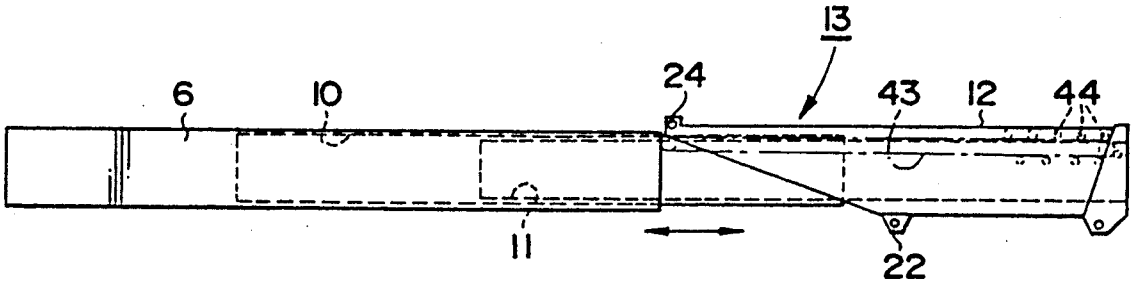

FIG. 13(A) shows the state wherein the telescopic boom body 13 is in a first state wherein the load applied to the pin holes 22 is supported by the rollers 24. With further advancement of the telescopic elongation operation of the telescopic boom body 13, the lower boom 6 is pulled out from the cover body 12 so that the rollers 24 are moved away from the upper surface of the lower boom 6 (refer to FIG. 13(B)). At this time, the rollers 44 were already pulled out by the middle boom 10 between the upper boom 11 and the cover body 12 so that the load applied to the pin holes 22 is transmitted to the cover body 12 by way of the rollers 44 and the like, thereby keeping the spacing between the cover body 12 and the lower boom 11 in parallel.

Figure 13C:
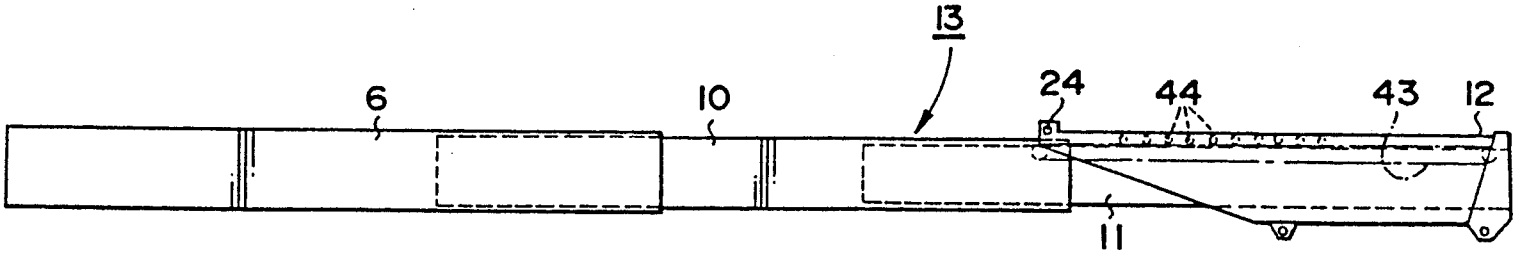

When the middle boom 10 is pulled out from the lower boom 6, the distance between the tip end of the upper boom 11 and the middle boom 10 is increased so that the rollers 44 are disposed in equal intervals and roll between the upper boom 11 and the cover body 12. As a result, the upper boom 11 is successively pulled out from the middle boom 10 and finally stopped at the state as illustrated in FIG. 13(C) which shows the maximum elongation position of the telescopic boom body 13. The telescopic boom body 13 can smoothly move telescopically by the contact and rolling support between the telescopic boom body 13 and the rollers 24 and the rollers 44.

When the telescopic boom body 13 is contracted, the telescopic boom body 13 moves in the manner that the upper boom 11 is inserted into the middle boom 10 while the chains 43 move in the opposite direction so that the rollers 44 are accommodated inside the upper boom 11. When the upper end of the lower boom 6 contacts the lower end of the cover body 12, the rollers 24 start to roll on the upper surface of the lower boom 6. As a result, the telescopic boom body 13 operates in the order of states illustrated in FIGS. 13(C) to 13(A) so that the load applied to the cover body 12 can be first applied to the rollers 44 and then applied to the rollers 24. Although the rollers 44 serving as spacers are cylindrical according to the present invention, the spacers may be square or polygonal if they are filled between the cover body 12 and the upper boom 11 and capable of operating in the same manner as the rollers 44.

As mentioned above, the telescopic boom body 13 is inclined by the first hydraulic cylinders 9 and at the same time it is elongated in the longitudinal direction thereof by the third hydraulic cylinder 86. At this time, since the oil under pressure is supplied to the second hydraulic cylinder 18 in parallel with the hydraulic cylinder 9, the second hydraulic cylinder 18 elongates in synchronism with the first hydraulic cylinder 9. The second hydraulic cylinder 18 operates to increase the angular spacing between the telescopic boom body 13 and the platform 16. When the elongation amounts of the first and second hydraulic cylinders 9 and 18 become equal to each other, the angular spacing between the chassis 1 and the telescopic boom body 13 becomes equal to the angular spacing between the platform 16 and the telescopic boom body 13. Accordingly, the lifting apparatus is substantially Z-shaped when viewed from the side thereof and the platform 16 is always kept in parallel with the chassis 1 for preventing an operator or material loaded on the platform 16 from dropping off the platform.

When the first, second and third hydraulic cylinders 9, 18 and 86 are independently operated, the telescopic boom body 13 is inclined relative to the chassis 1 and the platform 16 is always maintained in parallel with the chassis 1. At the same time, the telescopic boom body 13 can be operated to increase the length thereof. However, if the first, second and third hydraulic cylinders 9, 18 and 86 operate arbitrarily, the platform cannot rise vertically relative to the chassis even if it can rise upwardly. As a result, the platform can rise while the height of the platform from the chassis varies at the front and rear portions thereof, which causes the platform to be unstable. Accordingly, it is impossible to raise the platform vertically relative to the chassis if the first and second hydraulic cylinders 9 and 18 are not synchronous with the third hydraulic cylinder 86. The synchronization of inclination and the elongation of the telescopic boom body 13 will be described with reference to FIG. 12.

In the case of raising the platform 16, the lever 88 is pushed upward so that the controller 87 supplies a signal to the control valve 83 and the control valve is selected to the "normal" position. The oil under pressure in the oil pump 81 is directly supplied to the first and second hydraulic cylinders 9 and 18 so that the telescopic boom body 13 is gradually inclined relative to the chassis 1. When the telescopic boom body 13 is inclined, the lower boom 6 and the pin 7 turn relative to the support brackets 5 and the gear 52 is turned at the same time by the inclination of the telescopic boom body 13. The turning of the gear 52 is transmitted to the gear 53 by way of the belt 54 so that the detecting shaft 51 is simultaneously turned. Accordingly, the signal disks 55 and 56 fixed to the detecting shaft 51 are turned in synchronization with the turning of the pin 7. The roller 61 contacting the outer periphery of the signal disk 55 can contact successively the recessed portions of the signal grooves 63 so that the lever 59 can be swung every time the roller 61 contacts a signal groove 63. The swinging motion of the lever 59 is transmitted to the rod 67 whereby the timing switch 57 can be turned on or off. When the timing switch 57 is turned on every time the roller 61 contacts a signal groove 63 and is turned off when the roller 61 does not contact a signal groove 63, the timing switch 57 supplies an ON-signal and an OFF-signal to the synchronous circuit 89, respectively. The synchronous circuit 89 rectifies the wave of the ON/OFF signals to the pulse generating circuit 90. The pulse generating circuit 90 issues a pulse wave having a given width every time the ON-signal and the OFF-signal are supplied to the synchronous circuit 89. The pulse wave is supplied to the synchronous valves 84 and 85. Every time the synchronous valves 84 and 85 receive the pulse wave, they are released so that the oil under pressure is supplied from the oil pump 81 to the third hydraulic cylinder 86. Accordingly, the oil under pressure is supplied to the third hydraulic cylinder 86 during the interval corresponding to the width of the pulse generated by the pulse generating circuit 90 whereby the third hydraulic cylinder 86 is elongated to the extent corresponding to the amount of oil under pressure supplied thereto.

The inclination angle of the telescopic boom body 13 and the elongation amount of the telescopic boom body 13 will be described with reference to FIG. 14.

When the telescopic boom body 13 is positioned in parallel with the chassis I at the position denoted at 13-1 and is raised upwardly to the positions denoted at 13-2, 13-3 and 13-4, respectively, the pin 15 moves upwardly as denoted at 15-1, 15-2, 15-3 and 15-4 for forming the trace S. The telescopic boom body 13 should be synchronous with the chassis 1 so that the trace S is vertical relative to the flat surface of the chassis 1. In this case, the elongation amount M of the telescopic boom body 13, when it is raised at the shallow inclination angle (from the position 13-1 to the position 13-2), is different from the elongation amount N of the telescopic boom body 13 when it is raised at a large angle (from the position 13-3 to the position 13-4). That is, provided that the included angle Θ, when the telescopic boom body 13 is changed from the position 13-1 to the position 13-2, is equal to the angle ⊖ when the telescopic boom body 13 is changed from position 13-3 to position 13-4, the elongation amount M of the telescopic boom body 13 at the position 15-2 and the elongation amount N of the telescopic boom body 13 at the position as denoted at 13-4 are different in the lengths thereof.

That is, when the telescopic boom body 13 follows the trace S, the elongation amount N should be greater than the elongation amount M. Accordingly, the elongation amount of the telescopic boom body 13 is not proportional to the inclination angle, but rather, increases relative to the inclination angle with a constant function as the inclination angle becomes higher. Hence, the signal grooves 63 defined in the outer periphery of the signal disk 55 have relatively wide spacings therebetween when the telescopic boom body 13 begins to rise (lower inclination angle) and relatively narrow spacings therebetween when the telescopic boom body 13 raises further with a higher inclination angle.

Figure 15:
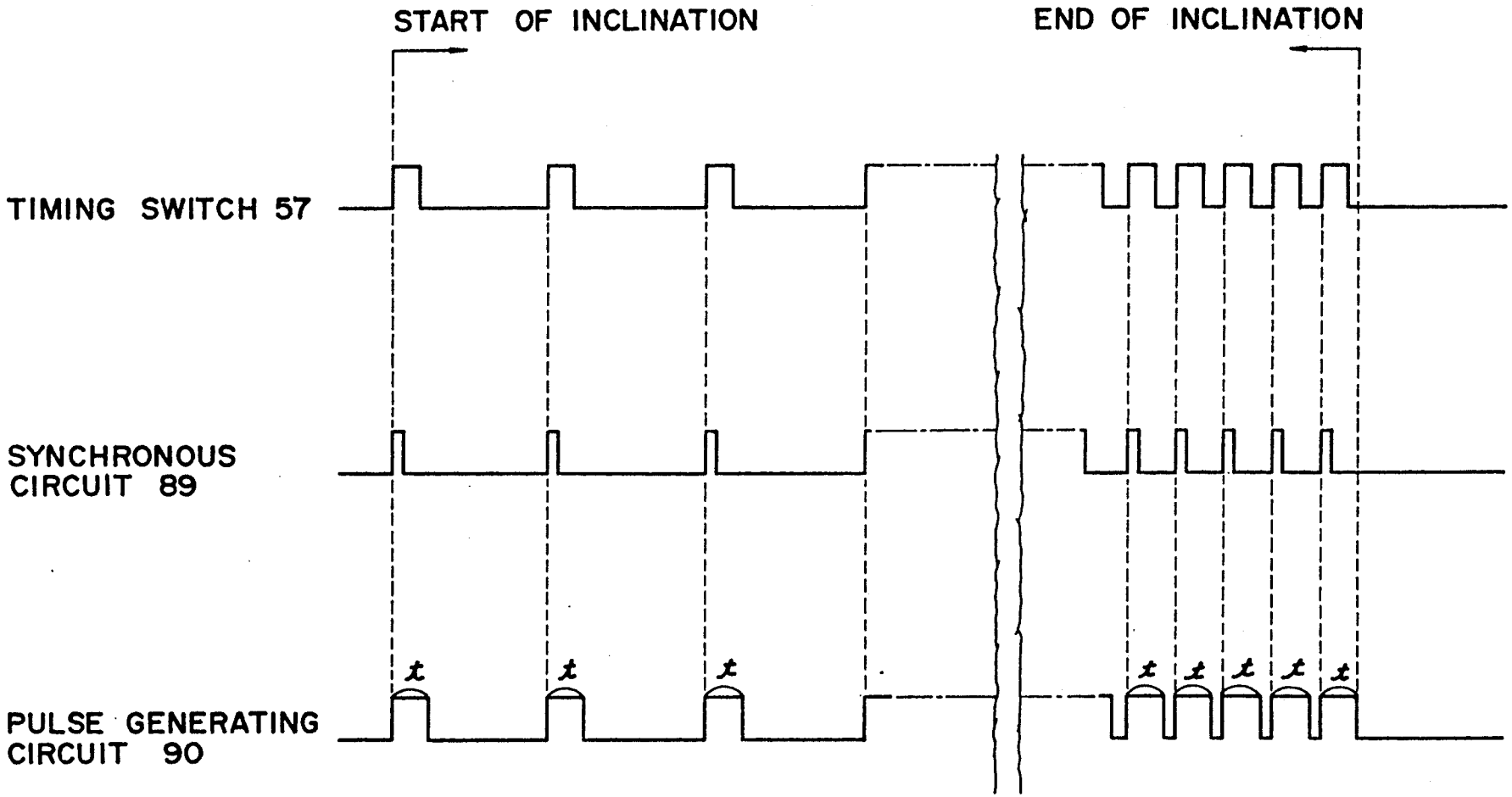
FIG. 15 is a timing chart showing the relation between the inclination angle of the telescopic boom body and the signals issued by a timing switch, a synchronous circuit and a pulse generator, respectively, all being the components of the lifting apparatus.

The relation between the inclination angle of the telescopic boom body 13 and compensation signals are illustrated in the timing chart of FIG. 15.

When the telescopic boom body 13 starts to incline relative to the chassis, the durations of the signals issued by the timing switch 57 are relatively short since the spacings between the signal grooves 63 are relatively wide and at the same time the output signals issued by the synchronous circuit 89 are short. Accordingly, the signals issued by the pulse generating circuit 90 for opening and closing the synchronous valves 84 and 85 are wide. The widths t of the pulse waves issued by the pulse generating circuit 90 are always output in the same width t irrespective of the elongation amount of the telescopic boom body 13 so that the telescopic boom body 13 can elongate for the amount of elongation amount M as illustrated in FIG. 14.

As the inclination angle of the telescopic boom body 13 becomes steeper, the spacings between the signal grooves 63 become narrower so that the intervals of the signals issued by the timing switch 57 and the synchronous circuit 89 become short and the intervals of the pulse waves issued by the pulse generating circuit 90 are also short. Since the oil under pressure is supplied from the oil tank 82 to the third hydraulic cylinder 86 during the intervals of the pulse widths t of the pulse wave issued by the pulse generating circuit 90, the intervals of the pulse waves issued by the pulse generating circuit 90 become short. Hence, a large amount of the oil under pressure is supplied to the third hydraulic cylinder 86. As a result, the elongation length of the telescopic boom body 13 becomes longer as the inclination angle thereof becomes steeper so that the telescopic boom body 13 elongates a length corresponding to the elongation amount N as illustrated in FIG. 14.

Figure 14:
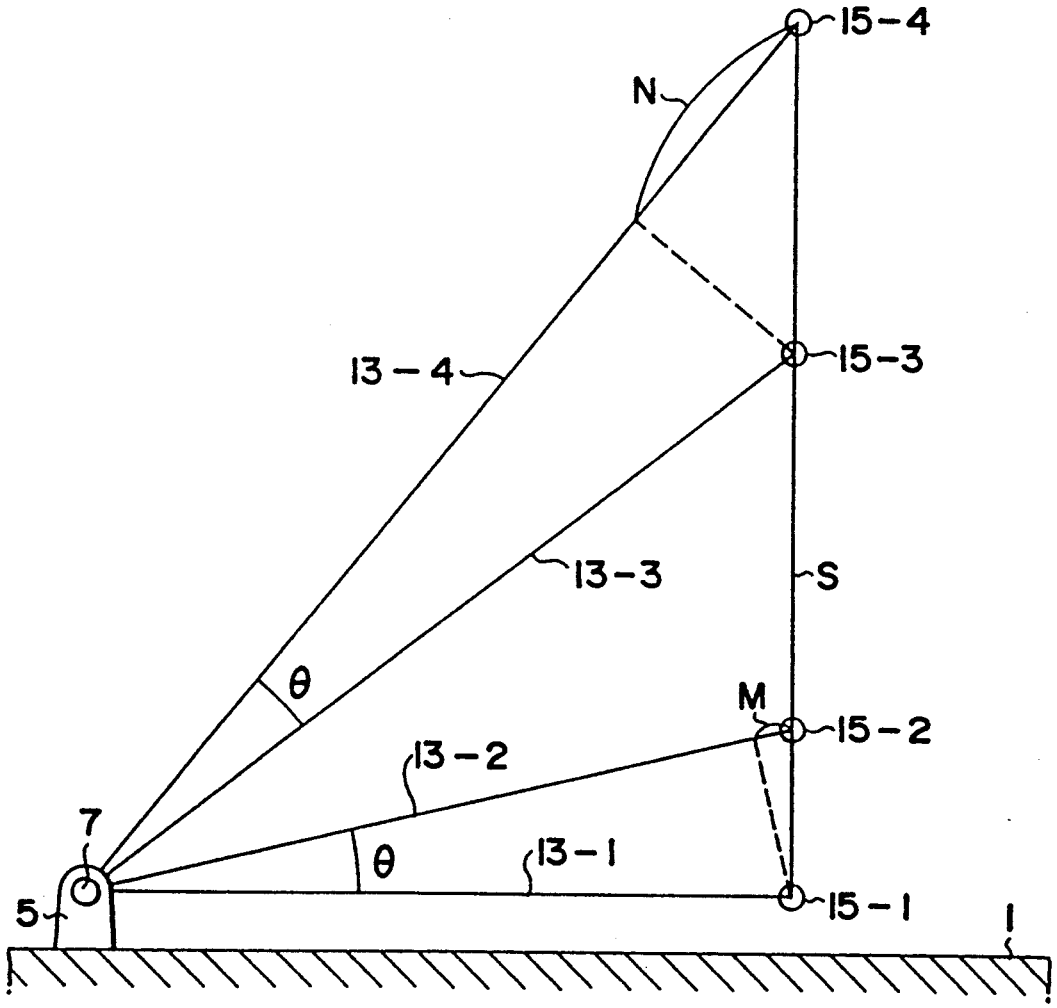
FIG. 14 is a graph showing the relation between the inclination angle of the telescopic boom body relative to the chassis and elongation amount of the telescopic boom body.

The required elongation length of the telescopic boom body 13 for each inclination angle thereof is compensated by the spacings of the signal grooves 63 defined on the outer periphery of the signal disk 55 so that the trace S formed by the tip end of the telescopic boom body 13 traces on the straight line S perpendicular to the chassis 1 as illustrated in FIG. 14. Accordingly, the platform 16 is raised vertically relative to the chassis 1.

As mentioned above, when the lever 88 of the controller 87 is pushed at the upper side, the first to third hydraulic cylinders 9, 18 and 86 are respectively operated synchronously with each other so as to raise the platform 16. When the platform 16 is raised to the given position, the lever 88 is returned to the "neutral" position to thereby close the control valve 83 whereby the platform 16 is kept at the same height.

When the working at the elevated height is completed, the platform 16 should be lowered. In this case, when the lever 88 is pushed at the lower side, the control circuit 87 permits the control valve 83 to be positioned at the "backward" position so that the oil under pressure is supplied to the first to third hydraulic cylinders 9, 18 and 86 in the direction opposite to the direction set forth above, whereby the inclination angle of the telescopic boom body 13 is reduced and at the same time the entire length of the telescopic boom body 13 is shortened.

At this time, since the lever 59 successively contacts the signal grooves 63 defined in the outer periphery of the signal disk 55, the lever 59 is pivoted by the signal grooves 63. The pulse generating circuit 90 turns on or turns off the synchronous valves 84 and 85 in response to the swinging motions of the lever 59 so that the contracting amount of the third hydraulic cylinder 86 is permitted to follow the variation of the inclination angle while it is permitted to be synchronous with the inclination angle.

The initial contracting speed is high since the intervals between the signal grooves 63 are narrow when the inclination angle of the telescopic boom body 13 is steep. As the inclination angle of the telescopic boom body 13 becomes shallower, the intervals between the signal grooves are widened so that the intervals of the pulse waves issued by the pulse generating circuit 90 become long whereby the intervals for turning on or off the synchronous valves 84 and 85 become long. As a result, the contracting speed of the third hydraulic cylinder 86 becomes smaller so that the pin 15 provided at the tip end of the telescopic boom body 13 follows the trace S as illustrated in FIG. 14. Consequently, the platform 16 is lowered in a direction vertically relative to the chassis 1.

When the telescopic boom body 13 is lowered until it becomes parallel with the chassis 1, it does not lower beyond a position where it is in parallel with the chassis 1. This position is the lowest one in which the platform 16 can be positioned and the lowering motion is completed. At this time, when the telescopic boom body 13 is lowered until it becomes parallel with the chassis 1 at the position as denoted at 13-1, the roller 62 contacts the reset groove 64 defined on the signal disk 56 so that the timing switch 58 supplies the reset signal to the reset circuit 91. Since the reset circuit 91 has already received an instruction signal from the controller 87 representing that the telescopic boom body 13 is low at this time, the reset circuit 91 allows the permission of the same signal. Accordingly, the reset signal issued by the timing switch 58 is supplied to the pulse generating circuit 90 to inform the pulse generating circuit 90 that the telescopic boom body 13 is positioned at the lowest position. As a result, the pulse generating circuit 90 permits the synchronous valves 84 and 85 to keep open during a prescribed time so that the oil under pressure is supplied from the oil pump 81 to the third hydraulic cylinder 86. With the supply of the oil under pressure during the prescribed time, the third hydraulic cylinder 86 is contracted to its minimum.

When the inclination angle of the telescopic boom body 13 is most shallow at the position as denoted at 13-1 in FIG. 14, the length of the telescopic boom body 13 is contracted to its minimum. The resetting operation by the reset circuit 91 contracts the telescopic boom body 13 to the minimum to thereby place it in standby condition for the next operation. The resetting operation is carried out to assure that the tip end of the telescopic boom body 13 traces on the trace S as illustrated in FIG. 14, in the next operation even if, in the preceding operation, the tip end of the telescopic boom body 13 did not trace on the trace S because of some deviation between the inclining operation and the elongation operation of the telescopic boom body 13.

With the arrangement set forth above, two systems of controls from the inclining operation and the elongation operation of the telescopic boom body 13 can follow the inclination angle of the telescopic boom body 13. Accordingly, the platform connected to the upper end of the telescopic boom body can be raised vertically relative to the chassis. In the operation, both the inclining operation and the elongation operation can be controlled by the control of the hydraulic circuit having the simple structure without using a high-priced instrument, such as a computer, so that the lifting apparatus can be manufactured at low cost. Furthermore, the hydraulic circuit has the control means for the following operation, so that the hydraulic circuit can be simplified.

What is claimed is:

1. In a lifting apparatus comprising:

a movable chassis;

a platform disposed over said chassis;

an elongated telescopic boom body extending between said chassis and said platform, said boom body comprising a plurality of boom sections which are telescopable into and out of said telescopic boom body in the longitudinal direction thereof;

inclining means interposed between said chassis and said telescopic boom body for raising said telescopic boom body so that it is inclined with respect to said chassis;

extension means housed within said boom body for telescoping said boom body to elongate and contract same;

wherein said platform, said telescopic boom body and said chassis are arranged to form a Z-shape when viewed from the side thereof and said telescopic boom body is telescopically moved and inclined relative to said chassis so as to move said platform vertically, the improvement which comprises an angle detecting means for issuing a signal corresponding to the angle of inclination of said telescopic boom body relative to said chassis when said telescopic boom body is inclined relative to said chassis, means responsive to a signal from said angle detecting means for operating said extension means for causing the elongation speed of the telescopic boom body to follow the variation of the angle of inclination of the telescopic boom body relative to said chassis so that the tip end of said telescopic boom body moves vertically relative to said chassis.

2. A lifting apparatus as claimed in claim 1 wherein said inclining means comprises a first pair of hydraulically operated cylinders pivotally connected to and extending between said chassis and the lowermost boom section of said boom body, said first pair of cylinders being disposed on opposite lateral sides of said boom body.

3. A lifting apparatus as claimed in claim 2 wherein said platform is pivotally connected to the uppermost boom section of said boom body, and a second pair of hydraulically operated cylinders pivotally connected to and extending between said platform and said uppermost boom section for tilting said platform relative to said boom body.

4. A lifting apparatus as claimed in claim 1 in which said boom sections each are hollow and are rectangular in cross-section and are longitudinally slidable and telescopable one within another.

5. A lifting apparatus as claimed in claim 4 in which said boom body comprises coaxial lower, middle and upper boom sections of progressively smaller cross section, an elongated channel-shaped cover body disposed over the upper end portion of said upper boom section, the walls of said cover body being spaced from the opposing walls of said upper boom section to provide a clearance space therebetween into which said lower and middle boom sections can be received, first roller means on said cover member for rollably supporting said upper boom section on said lower boom section when said boom body is in a position in which said upper boom section and said middle boom section are telescoped within said lower boom section and second roller means for rollably supporting said cover body on said upper boom section when said middle and upper boom sections are extended from said lower boom section and when said upper boom section is extended from said middle boom section.

6. A lifting apparatus as claimed in claim 1 wherein said extension means is a hydraulic cylinder actuator housed inside said boom body.

7. A lifting apparatus as claimed in claim 6 wherein said inclining means comprises first hydraulic cylinder means for pivoting said boom body relative to said chassis and said angle detecting means comprises actuator means responsive to movement of said boom body for providing, during each raising or lowering of said boom body, a series of signals indicative of the instantaneous angle of inclination of said boom body as said angle of inclination changes, and said means for operating said extension means comprises valve means responsive to said series of signals and connected for controlling supply of hydraulic fluid to said hydraulic cylinder actuator.

8. A lifting apparatus as claimed in claim 7 in which said actuator comprises a disc pivotal through an arc in response to pivotal movement of said boom body, said disc having a series of circumferentially spaced-apart grooves on the periphery thereof, and an on-off switch having a follower riding on the periphery of said disc so that said switch is turned on and off depending on whether or not said follower is disposed in one of said grooves, said grooves being spaced-apart in progressively smaller circumferential distances in the direction of pivoting movement of said disc so that the frequency of actuation of said switch is responsive to the angle of inclination of said boom body.

* * * * *